US006368251B1

(12) United States Patent
Casler et al.

(10) Patent No.: US 6,368,251 B1
(45) Date of Patent: Apr. 9, 2002

(54) MACHINE FORCE APPLICATION CONTROL WITH SAFETY BRAKING SYSTEM AND EXERCISE METHOD

(75) Inventors: John Casler; Kevin G. Abelbeck, both of Los Angeles, CA (US)

(73) Assignee: John A. Casler, Los Angeles, CA (US)

( * ) Notice: Subject to any disclaimer, the term of this patent is extended or adjusted under 35 U.S.C. 154(b) by 0 days.

(21) Appl. No.: 09/482,559

(22) Filed: Jan. 13, 2000

(51) Int. Cl.[7] ..... A63B 21/00
(52) U.S. Cl. ..... 482/4; 482/8; 482/901
(58) Field of Search ..... 482/1–9, 900, 482/901, 902

(56) References Cited

U.S. PATENT DOCUMENTS

| | | | |
|---|---|---|---|
| 5,015,926 A | 5/1991 | Casler | |
| 5,020,794 A | 6/1991 | Englehardt et al. | |
| 5,180,348 A | 1/1993 | Saarinen | |
| 5,314,394 A | 5/1994 | Ronan | |
| 5,354,248 A | 10/1994 | Rawls et al. | |
| 5,409,435 A | 4/1995 | Daniels | |
| 5,435,798 A | 7/1995 | Habing et al. | |
| 5,565,002 A | 10/1996 | Rawls et al. | |
| 5,569,120 A | 10/1996 | Anjanappa et al. | |
| 5,583,403 A | 12/1996 | Anjanappa et al. | |
| 5,643,157 A | 7/1997 | Seliber | |
| 5,697,869 A | 12/1997 | Ehrenfried et al. | |
| 5,762,584 A | 6/1998 | Daniels | 482/75 |

OTHER PUBLICATIONS

Gardner, G.W., Specificity in Strength Changes . . ., *Res. Q.*, 34(1): 98–101, 1963.
Lindh, M., Increase of Muscle Strength . . ., *Scan J. Rehab Med.* 11:33–36, 1979.
Magpower Clutch/Brake, model CBP, MagPower Designer's Notebook, 2 nd Ed., pp. 162–163.

*Primary Examiner*—Glenn E. Richman

(57) ABSTRACT

A machine force system and control for an exercise device is disclosed. The device includes a drive motor and a brake the combination of which is mechanically fastened to the input shaft of a clutch. This clutch can take a variety of forms but is preferably an electrically controlled particle clutch. The output shaft of the clutch is in mechanical communication with the exercise arm of the exercise device. In the preferred embodiment, this mechanical communication is through a gear reduction and preferably a multiple reduction. This reduction increases the torque from the clutch to the exercise arm while reducing the speed of movement. A sensor to indicate the position of the exercise arm and a microprocessor unit to read, compare and operate the brake, motor and clutch is also included. The system includes a variety of exercises including isotonic, isokinetic and increased eccentric dynamic force, passive dynamic force and static isometric and stepped isometric resistance.

62 Claims, 6 Drawing Sheets

MACHINE FORCE APPLICATION CONTROL WITH SAFETY BRAKING SYSTEM AND EXERCISE METHOD

BACKGROUND OF THE INVENTION

The invention relates to exercise devices and methods for controlling exercise devices Most popular equipment in the strength training or resistance type exercise equipment still rely on iron weights in the presence of gravity as the mechanism for force or resistance to the user. Few have ventured from that norm. Though this type of force or resistance mechanism system may have advantages over less common force application systems, they are for the most part limited in their function and safety. As a result, attempts have been made to make strength training exercise machines more dynamic in their capabilities and at the same time safer to use.

SUMMARY OF THE INVENTION

1. Present Invention

In one aspect, the invention features a machine force system and control for an exercise device that includes an exercise arm with an engagement portion for providing force transmission between a user and the exercise device. The system also includes a mechanical power system which includes a drive motor, a clutch with an input in mechanical communication with the drive motor and an output in mechanical communication with the exercise arm, and a brake that is coupled to the input of the clutch. The clutch enables a variable power output from the motor to the exercise arm, and the brake, when actuated, provides a restriction to the movement of the input of the clutch.

The system may also include a secondary resistance mechanism connected to the exercise arm which applies a load to oppose a movement of the exercise arm and a brake that is coupled to the input of the clutch.

In another aspect, the invention includes an exercise method utilizing the aforementioned system for applying a force to the exercise arm to which a user provides a force in opposition thereto on the engagement portion of the exercise arm. This is done in an attempt to overcome the force provided by said mechanical power system, thus exercising the muscles of the user.

2. Definition of Terms

Unless otherwise defined, all technical and scientific terms used herein have the same intended meaning as would be commonly understood by anyone of ordinary skill in the art to which this invention belongs. To eliminate possible ambiguity specific terms used herein have been defined as they would be applied to the present invention.

An "exercise arm" is a movable structure associated with an exercise device that can be displaced by the user upon application of force by the user to the arm. The exercise arm is commonly pivotally attached to the framework, or another pivoting link of the exercise device, thus providing rotary motion of the arm by the user. In a similar manner, the arm can also be restricted to a linear or curve-a-linear path, or a combination of any or all of the above.

An "engagement portion" is the portion of the "exercise arm" that is intended to be the area of intimate interaction between the user and the exercise device. This is commonly comprised of one or more handles, for machines to exercise the upper body, or one or more foot plates for devices to stress the lower body. Pads may also be used for any part of the body.

"Reaction force" is the force applied from the exercise device back to the user.

"Dynamic force" is a category of exercise that requires movement of the exercise arm. This results in the muscle shortening or lengthening during a contraction of the muscle.

"Isotonic force" is a dynamic force in which the muscle is placed under a constant tension. The speed of the contraction is not restricted.

"Isokinetic force" is a dynamic force in which the muscle is allowed to contract only under a constant or virtually constant speed. In most cases this means the force applied by the user does not change the speed of movement of the exercise arm.

"Passive resistance" is movement of the joint of a user, and thereby to some degree the muscles associated therewith, completely under the power of an external source. This is commonly used with the physically impaired who cannot articulate the joint by their own muscular contraction.

"Concentric contraction" is the shortening phase of a dynamic muscular contraction. One concentric contraction is counted as one concentric repetition or one half of a full repetition.

"Eccentric action" is the lengthening phase of a dynamic muscular contraction. One eccentric movement is counted as one eccentric repetition or one half of a full repetition.

One "repetition" is one complete concentric phase of a movement and one complete eccentric phase of the same movement.

"Increased eccentric force" involves utilizing a greater force in the eccentric phase as compared to the concentric phase of a repetition of an exercise. This can be a desirable combination in light of skeletal muscle's ability to generate greater tension eccentrically as compared to concentrically.

"Static resistance" is a category of exercise which involves placing the muscle under tension without movement of the muscle or exercise arm.

"Isometric resistance" is a static resistance in which the load is applied to the exercise arm by the user without movement of the exercise arm.

"Stepped isometric resistance" is a modified static resistance in which force is applied to the exercise arm by the user without movement of the exercise arm for a specified period of time. Following this, the exercise arm is moved or allowed to be moved to the next step, where the user again applies force to the exercise arm without movement of the arm. This sequence can be repeated any number of times for a simulated "concentric" repetition.

"Stepped eccentric force" is a modified dynamic force in which the load is applied to the exercise arm while the muscle is lengthening (eccentric phase) and periodically the resistance is increased to a level in which the user cannot stop the eccentric movement. The force is then decreased to the previous resistance value enabling the user to stop movement of the arm. This cycle may be repeated numerous times during one eccentric repetition.

DETAILED DESCRIPTION OF THE PREFERRED EMBODIMENT

The object of the disclosed invention is to provide an improved force application and control system, especially used for physical exercise. In a preferred embodiment, the system includes a positive drive mechanism, typically an electric motor with a brake and a clutch attached thereto, the brake and motor attached to the input of the clutch. Since the brake and the motor are attached to the input to the clutch, either rotary movement or resistance to movement can be smoothly transferred through the clutch to the exercise arm. The output of the clutch is attached to some form of gear reduction, as deemed necessary by the torque capabilities and requirements of the system. This is mechanically coupled to the exercise arm, a portion of which includes handles or foot plates as an engagement portion to interact with the user.

Figure 1:
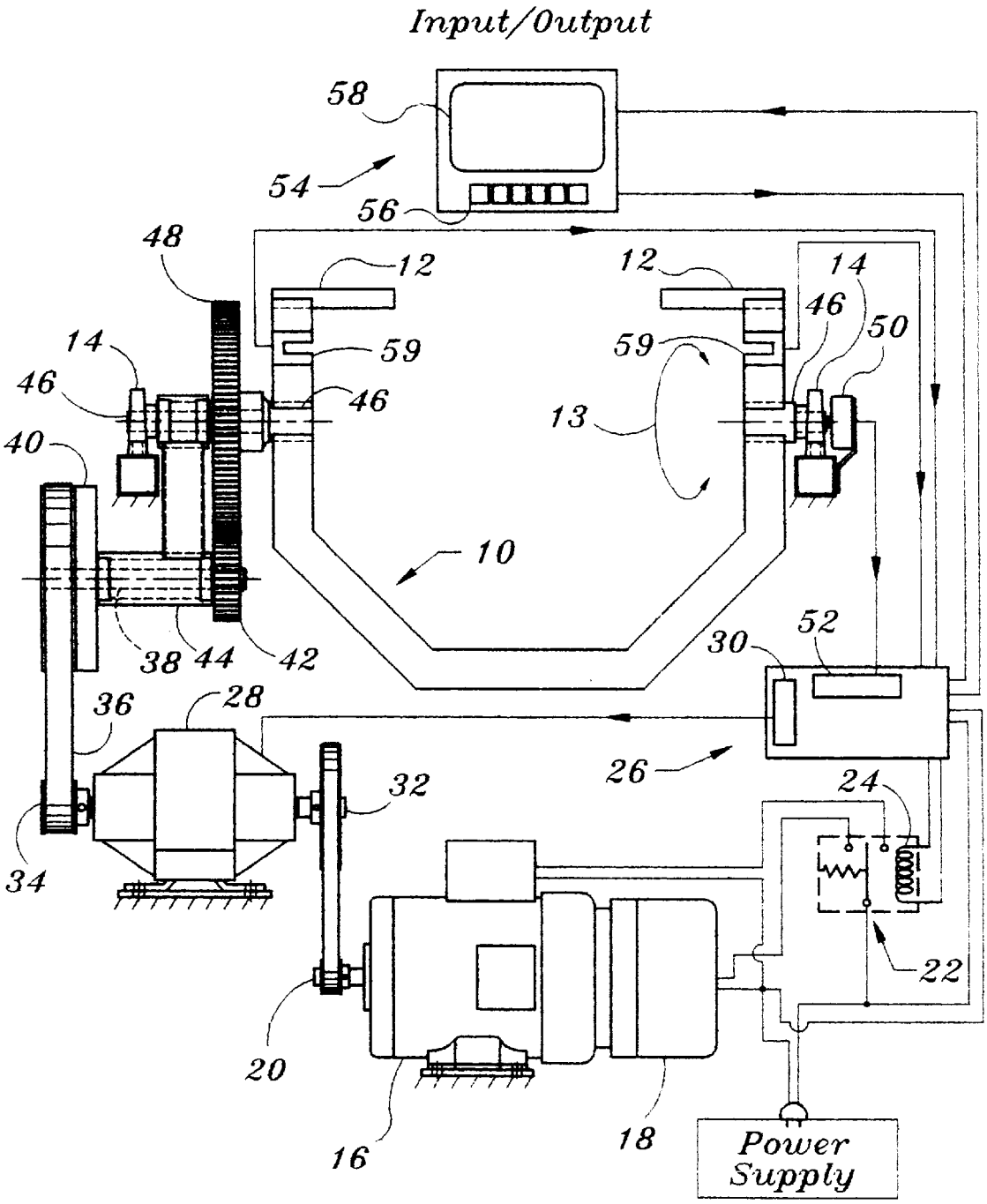
FIG. 1 is a schematic view of a force application and control system for an exercise machine, the device with a brake mounted on the motor produced in accordance with the preferred embodiment of the present invention.

A schematic of a basic system, including some of the actual mechanical features of the machine, is shown in FIG. 1. Here the machine is depicted by an exercise arm 10 which includes a set of handles 12. The handles 12 are intended to be the engagement portion of the exercise machine in that this is the area of interaction between the machine and the user. Handles are grasped by the hands of the user to exercise the muscles of the upper body and torso of the user. A similar engagement portion would be a foot plate (not shown) with which the user's feet would interact to apply force to the machine. Other structures such as pads and rollers or any other form commonly used in the art, would also function equally well dependent upon the type of machine and the muscles intended to be exercised. Throughout this disclosure only this handle type of engagement portion will be shown, but this is not intended to limit to the scope of the invention.

The exercise arm 10 is supported by two bearings 14 thus allowing the exercise arm 10 to be pivotally displaced. In this case in the handles 12 would rotate in an arcuate path. As shown by the arrow 13, about the center of rotation of the bearings 14. Again this is only one of many typical machine functions that are common in the art, and this type of movement is not critical to the function of the disclosure, and therefore not intended to be limiting.

Resistance to movement of the exercise arm 10 can be provided by the drive motor 16 or the brake 18. In this figure, the brake 18 is in the form of a motor brake that mounts directly on the motor 16. This mechanically specific function is not necessary to the novelty of the invention, other than the function of enabling a restriction to movement of the motor shaft 20. The motor shaft runs through the housing of the motor and communicates with the brake 18, typically a solenoid operated friction brake, on the opposite end of the output shaft of the motor 16. The brake 18 is mechanically fastened to the housing of the motor 16, thus when actuated, the brake 18 provides a reaction force to resist movement of the motor shaft 20.

The method of controlling the actuation of the brake 18 and the motor 16 can be done in a variety of electric or electronic means. What is shown here is a simple and reliable method using an electric relay 22. The relay 22 shuttles current flow to either the brake 18 or the motor 16 according to the activation of the coil 24 in the relay 22. The activation of the coil 24 is controlled by the microprocessor unit 26. Though the specific relay setup is not intended to be limiting, it has been determined that for increased safety of the system the deactivated terminal or normally closed (N.C.) terminal should be connected to the brake 18 and the normally open (N.O.) terminal should be connected to the motor 16. This insures that in case of a loss of power to the relay 22 the brake 18 would be activated and not the motor 16.

The transmission of power from the motor 16 or the clutch 18 to the exercise arm 10 passes through a clutch 28. A variety of clutches can be used for the purpose of controlling torque transmission. It has been determined that the most desirable type of clutch is an electrically controlled clutch and preferably an electric particle clutch. This enables rapid variation in force transmission through variation in the coil current of the clutch 28. Typical particle clutches can accomplish this with low voltage D.C. (direct current) systems that are safe and with minimal programming complexity. This current is controlled by use of the clutch driver 30 which is driven by, and is part of, the microprocessor unit 26.

The resultant capabilities of this system include a dynamic input or a restriction to movement of the input shaft 32 of the clutch 28. The clutch driver 30 of the microprocessor unit 26 varies the torque output of the output shaft 34 of the clutch 28. The output shaft 34 is mechanically connected to the exercise arm 10 via a variety of methods. Here is shown a preferable method which includes an output belt drive 36 which acts as a gear reduction to the gear shaft 38. The gear shaft 38 allows a speed reduction and torque increase to the system through large pulley 40 to small gear 42. The gear shaft 38 is supported by a support tube 44 which is pivotally mounted to exercise arm shaft 46 and the previously noted bearings 14. This allows a second speed reduction and torque increase from small gear 42 to the large gear 48 while allowing movement of the large pulley 40 relative to the clutch 28 to insure proper tension of the belt 36. The large gear 48 is secured to the exercise arm 10, this thereby completing the torque transmission from the output shaft 34 of the clutch 28 to the handles 12 of the exercise arm 10.

The use of the afore mentioned gear reduction system to reduce the speed and increase the torque of the motor 16 with respect to the handles 12 is useful with the present technology. A possible alternative is the use of a low speed, high torque motor, brake and clutch in which the output shaft 34 of the clutch 28 can be mechanically linked directly to the exercise arm 10. This would eliminate the need for the gear reduction system as disclosed.

Control of the clutch 28 by the clutch driver 30 of the microprocessor unit 26 is made in accordance with information input to the microprocessor unit 26. A portion of this information comes from the position sensor 50 on the exercise arm 10, shown here to be on the arm shaft 46. A variety of position sensors can be used and the type is not intended to be limiting to this disclosure. One such sensor is an optical encoder. A signal from the sensor 50 is sent to a signal conditioner 52 within the microprocessor unit 26. The signal input is evaluated with respect to time within the microprocessor unit 26 to determine the speed and acceleration of movement of the handles 12 as well as the position at any time. Algorithms programmed into the microprocessor unit are compared to the position, speed and acceleration input to control the relay 22 by activation of the coil 24, thus applying dynamic force or braking force and a control of such force by the input to the clutch 28.

Individualized algorithms can be made by the microprocessor unit 26 by varying the input of certain variables of those algorithms according to certain aspects of the user. This is accomplished by use of the input aspect of the input/output device 54. Knobs or buttons 56, as shown here, can be used to input data. Any of a number of other forms of data transmission, including touch screen technology, where a portion of the liquid crystal display (L.C.D.) or a more common cathode ray tube (C.R.T.) can be used as a key pad or keyboard, can also be used to input data about the user. This data may include the user's height, weight, age, sex and history of exercise frequency and various other indicators as to the user's relative fitness levels. This information is used to vary the user's resistance and exercise protocol to make a more effective exercise system for the user.

Also, the input portion of the system can be used to identify the user to the system. This can be accomplished by the user physically inputting a form of identification by way of the input/output device 54, or by an electronic device on located on or held by the user. Such a device can be any uniquely distinguishable device such as a magnetic strip, as found on a credit card or a microchip on an object such as a key chain that is then inserted into a "reader" on the device. Telemetry units can also be used in a similar manner thus eliminating the need for inserting the device into the reader. When the user is in close proximity of the device, the user will be identified by the signal emitted by the telemetry unit.

The electrical and electronic design for this system as shown here and in the following figures is determined by the applicants to be the preferred embodiments of the invention. It is understood that numerous sensors and switching mechanisms are commonly known in the art which are capable of enabling the proper function of the invention. As such, the electrical diagrams are not intended to be limiting to the scope of the invention.

Performance data, including force used, exercise arm position, number of repetitions performed and total work done per exercise session can be displayed to the user via the display 58 of the input/output device 54. In addition, the display portion of the input/output device 54, though shown to be visual representation, is not intended to be limited to a visual form of communication of the device to the user. Audio feedback through verbal or other auditory stimulation (such as varying the pitch or frequency of a tone) through a sound system including speakers on the device. The speakers would optimally be located near the ears of the user and can be used to communicate "greater", "lesser", "faster" or "slower" or other general information to the user. This instructs the user as to progress or performance after or during the workout session. In a similar manner, tactile stimulation can also be used. The frequency and/or intensity of a vibration as felt by the user can also communicate this information.

The preferred embodiment uses a visual display, as such, the specifics of the display are not considered critical and can include seven segment LCD's, seven segment LED's (light emitting diodes) or either a conventional LCD or CRT screen would comprise the current state of the art. The applicants consider this rapidly changing technology and again do not intend to limit the invention by the type of the display. Although the presence of the performance data is very desirable to the motivation and education of the user, it is possible for the invention to function without the input/output function. The microprocessor unit 26 would be preprogrammed with generic algorithms and no output display would be used. The applicants feel it is beneficial to include the input/output capability and so it is disclosed.

The functional exercises that can be performed by utilizing the system include isotonic force by running the motor 16 in the direction that would oppose the concentric contraction of the muscles in the movement of the exercise arm 10. The clutch 28 is then regulated to transfer enough torque from the clutch input 32 to the clutch output 34 to apply a constant or relatively constant force during both the concentric and eccentric phases of movements of the muscle during the exercise session. The clutch 28 would naturally have a much greater slip during the concentric movement, as the direction of movement is opposing the movement of the motor 16 while during the eccentric phase of contraction the movement is in the same direction as the motor 16.

For an increased eccentric force arrangement, a similar process is used only the torque is increased during the eccentric phase of the muscle contraction as compared to the torque applied during the concentric phase of the muscular contraction. The direction of movement of the exercise arm 10 and therefore the phase of muscular contraction is monitored by the sensor 50 and microprocessor unit 26.

By monitoring the position versus time of the exercise arm 10 by use of the sensor 50 by the microprocessor unit 26, the velocity of the movement can be monitored. By finding the derivative of the function of the velocity of movement, the acceleration can be determined. If either of those values becomes to large, according to predetermined values, especially during the eccentric phase of the muscular contraction, the relay 22 can be switched by not energizing the coil 24 thus disengaging the motor 16 and engaging the brake 18. Then with full current to the clutch 28 maximum braking force would be employed to stop the movement of the exercise arm 10 within a fraction of a second, thus employing a safety feature of the system.

By monitoring the velocity of the movement of the exercise arm 10 as previously disclosed, a constant velocity or isokinetic type of dynamic force can be accomplished. In this case, a range of velocity of movement is determined and monitored by the sensor 50 and microprocessor unit 26 of the system. The torque output of the clutch 28 is then increased or decreased as needed to maintain the velocity within the acceptable range.

Along with these dynamic forms of force, the previously mentioned braking system can be employed to perform a series of static resistance exercises. By locking the input shaft 32 of the clutch 28, the current to the clutch 28 can be made great enough to stop motion of the exercise arm 10 at any position. The user can then perform an isometric muscular contraction against the handles 12 at maximum intensity without movement of the exercise arm 10.

At a predetermined load, through the user of a load sensor 59 or amount of time at any position, the current to the clutch 28 can be decreased to allow the exercise arm 10 to move a specified amount. This amount is monitored and controlled by the sensor 50 and the microprocessor unit 26. When the arm 10 has been displaced the predetermined amount, the current to the clutch 28 is increased again to once again stop the movement of the arm 10. This process is called stepped isometric resistance and can be continued for any distance of displacement or number of times during an exercise session. It is desirable because of the theory of range specific increases in strength through isometric training (Gardner, G., *Res Q*. 34:98–101, 1963; and Lindh, M., *Scand J Rehab Med*. 11:33–36, 1979). Therefore by stepping to various positions, the range is increased and as should follow, the strength increases.

This stepping process can also be used during the eccentric phase of a dynamic exercise session. This would be accomplished by increasing the eccentric load, by increasing the current to the clutch 28, to a force level that cannot be overcome by the user. This is done for a short duration of movement at which time the load is again decreased to the lower level, be that isotonic or increased eccentric force. The user resists the movement of the machine while performing an eccentric movement and again steps up the eccentric load for a short duration. This can be done any number of times during the eccentric phase of the exercise session. This is called stepped eccentric force.

For the physically impaired, a passive form of exercise can be employed. This involves the motor 16 being in the form of a reversible motor. This enables the exercise arm 10 to be actively driven in one or both directions, as necessary to move the user's muscles in a concentric phase and the eccentric phase. The brake 18 would be called into action to stop the rotation of the motor 16 at the end of each movement phase since the motor would in many cases change direction after each half repetition. The clutch 28 slips to apply gentle controlled movement of the exercise arm 10 while being constantly monitored by the sensor 50 and the microprocessor unit 26.

Limiting the range of motion of the exercise arm 10 is in many cases valuable, especially for injury rehabilitation. The object of the disclosed invention can also accomplish this function by use of the brake 18, reversible motor 16 and the clutch 28. The motor 16 can be driven to move the exercise arm 10 from its lowest position to any point within the range of motion of the machine. The brake 18 can then be actuated to set this lower limit of the arm 10 for that user. This position data is then retained by the microprocessor unit 26 by virtue of the sensor 50. The user can then move the arm 10 in a concentric movement under their own power against the resistance of the machine in a fashion as previously described. The user will stop at the upper end according to their ability, as normal. When the user moves the arm 10 eccentrically to the new lower position, the load by the motor 16 is stopped, the brake 18 is engaged and the clutch 28 is actuated to comfortably stop the arm 10. This can be repeated and the position reset each time for these users.

Figure 2:
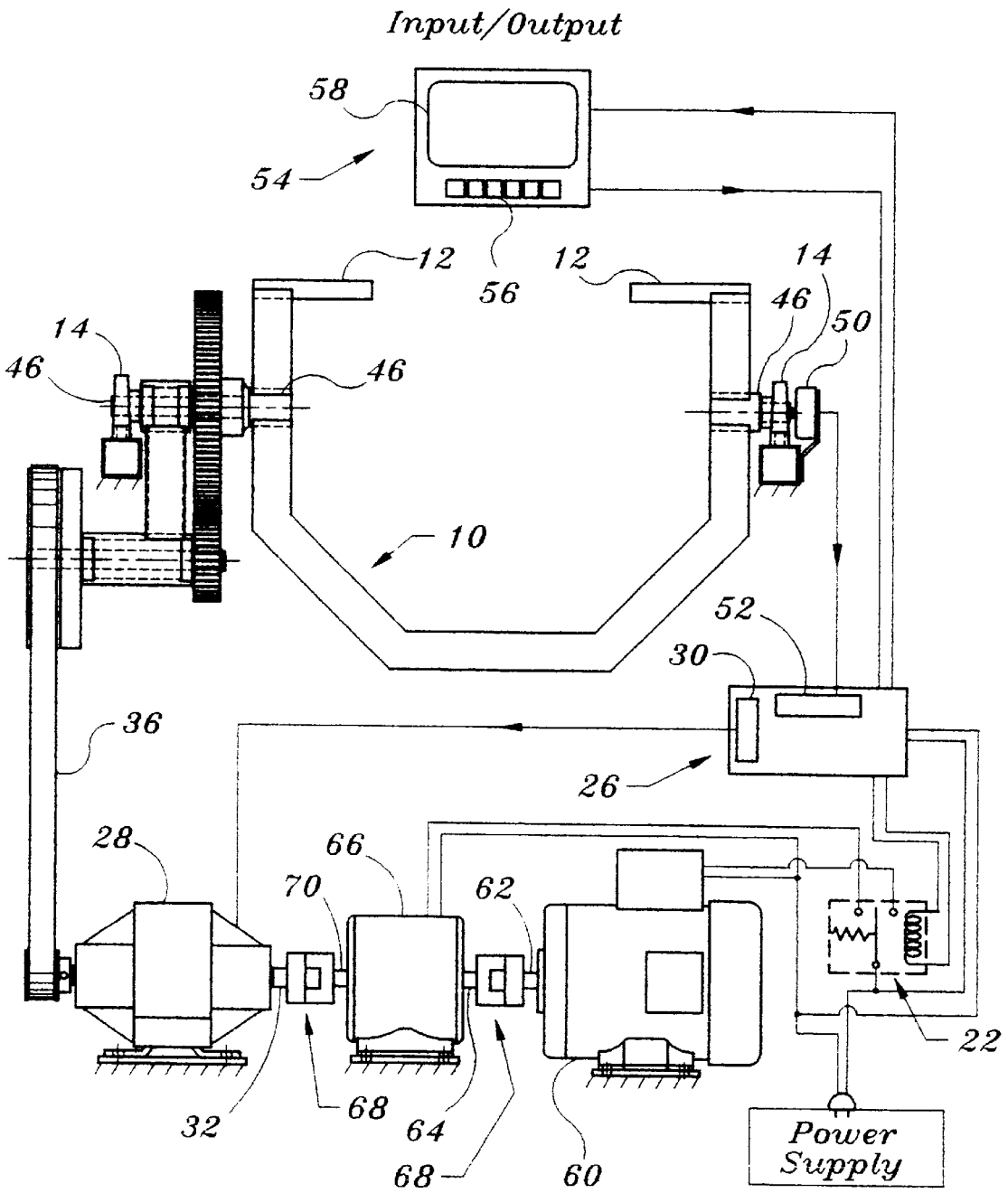
FIG. 2 is a schematic view of a force application and control system for an exercise machine, the alternative device with a separate brake produced in accordance with the preferred embodiment of the present invention.

A similar system, and identical in function, is depicted in FIG. 2 with another version of the drive system. The exercise arm through the belt 36 are identical to that described in FIG. 1. Also, the sensor 50, microprocessor unit 26 including the clutch driver 30, signal conditioner 52 and relay 22 are also functionally similar to that previously disclosed. The difference is in the use of a stand alone motor 60 with an output shaft 62 that is coupled to the input shaft 64 of a brake 66. The method of mechanical coupling is not critical to the invention and any form of shaft coupling 68 that is common to the art can be used. In a similar manner, the brake output shaft 70 is connected to the clutch input shaft 32. As before, this is accomplished by use of a shaft coupling 68. Though this method uses a stand alone motor 60 and a stand alone clutch 66 that are each individually mounted to the frame of the device, the use of the combination is similar to that previously described in that when the brake 66 is not engaged, the motor 60 is capable of transmitting dynamic torque through the brake 66 to the handles 12 of the exercise arm 10, by regulated by the clutch 28. With the motor 60 disengaged and the brake 66 engaged, the clutch 28 can regulate braking force to the handles 12 of the exercise arm 10.

Figure 3:
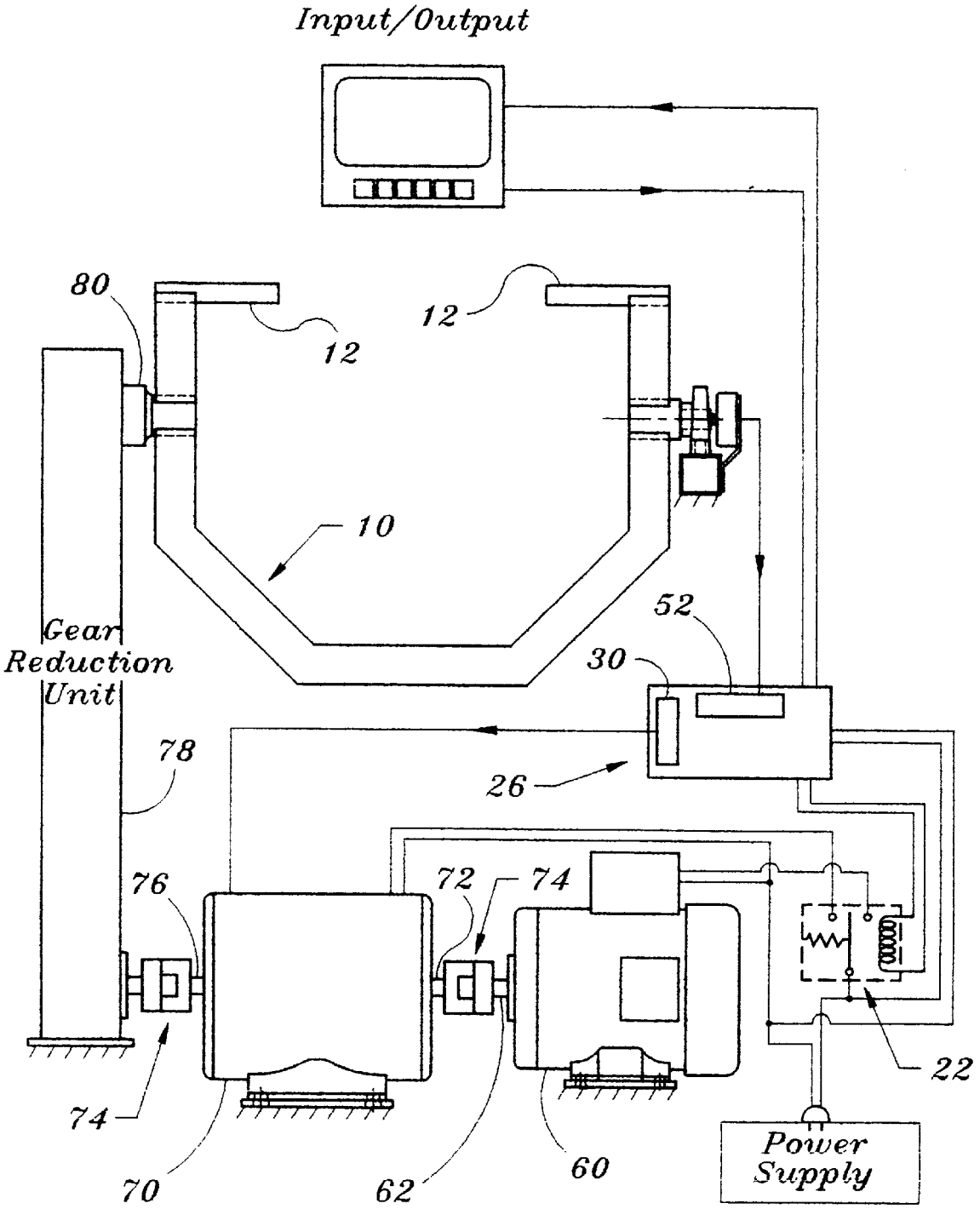
FIG. 3 is a schematic view of a force application and control system for an exercise machine, the second alternative device utilizing a clutch/brake produced in accordance with the preferred embodiment of the present invention.

Another variation is shown in FIG. 3 utilizing a clutch/brake 70 for the braking function and torque regulation. As in FIG. 2, many of the basic elements of this version of the disclosure are very similar to that disclosed in FIG. 1. Here in FIG. 3, the relay 22 is shown to shuttle power to the stand alone motor 60 and brake portion of the clutch/brake 70. The clutch portion of the clutch/brake 70 is, as before, controlled by the clutch driver 30 portion of the microprocessor unit 26. The motor output shaft 62 is coupled to the clutch/brake input shaft 72 by use of coupling 74. Since the clutch/brake 70 is capable of performing both tasks of applying braking torque that is regulated through the clutch portion of the clutch/brake 70 as well as work as a clutch, regulating torque output from the motor 60, the design can be somewhat simplified without sacrificing performance of the invention. An example of a clutch/brake 70 is the "model CBP" by Magpower$^R$ (Magnetic Power Systems, Inc., Fenton, Mich. 63026).

The clutch/brake output shaft 76 is shown here to be mechanically connected to a gear reduction unit 78 by coupling 74. The purpose of the gear reduction unit 78 is likely a multiple reduction but is shown here to be housed in a single unit. The output shaft 80 is mounted directly to the exercise arm 10. This type of gear reduction functions similar to that previously disclosed in that the speed is reduced and the torque increased from the clutch to the exercise arm 10 and as such, in the scope of the invention, could be interchanged with any of the other previously noted versions of the invention or any not shown that is commonly known in the art.

In some fields of study, a system of resistance as based on a mass in the presence of gravity is preferred to other means of force applied to the body. Because the exact mechanism (s) associated with muscular adaptation to stress are not completely understood by modern science, we cannot offer a conclusive explanation as to why this might be an advantage. We can observe the development of our species, and only over the past 100 or so years, our muscles have been subjected to non-gravity based resistance systems such as springs, hydraulics and pneumatics. Considering our species is on the order of 2 million (+) years old it is understood that the body's response to a gravity based resistance would be superior to other forms. Theorists have speculated the presence of the inertia in the mass is important to the physical adaptation to exercise (increased strength and hypertrophy). Athletes desire to train as they perform. This strengthens the neurologic pathways important to them. All athletes move a mass in the presence of gravity, if nothing other than their own body.

Figure 4:
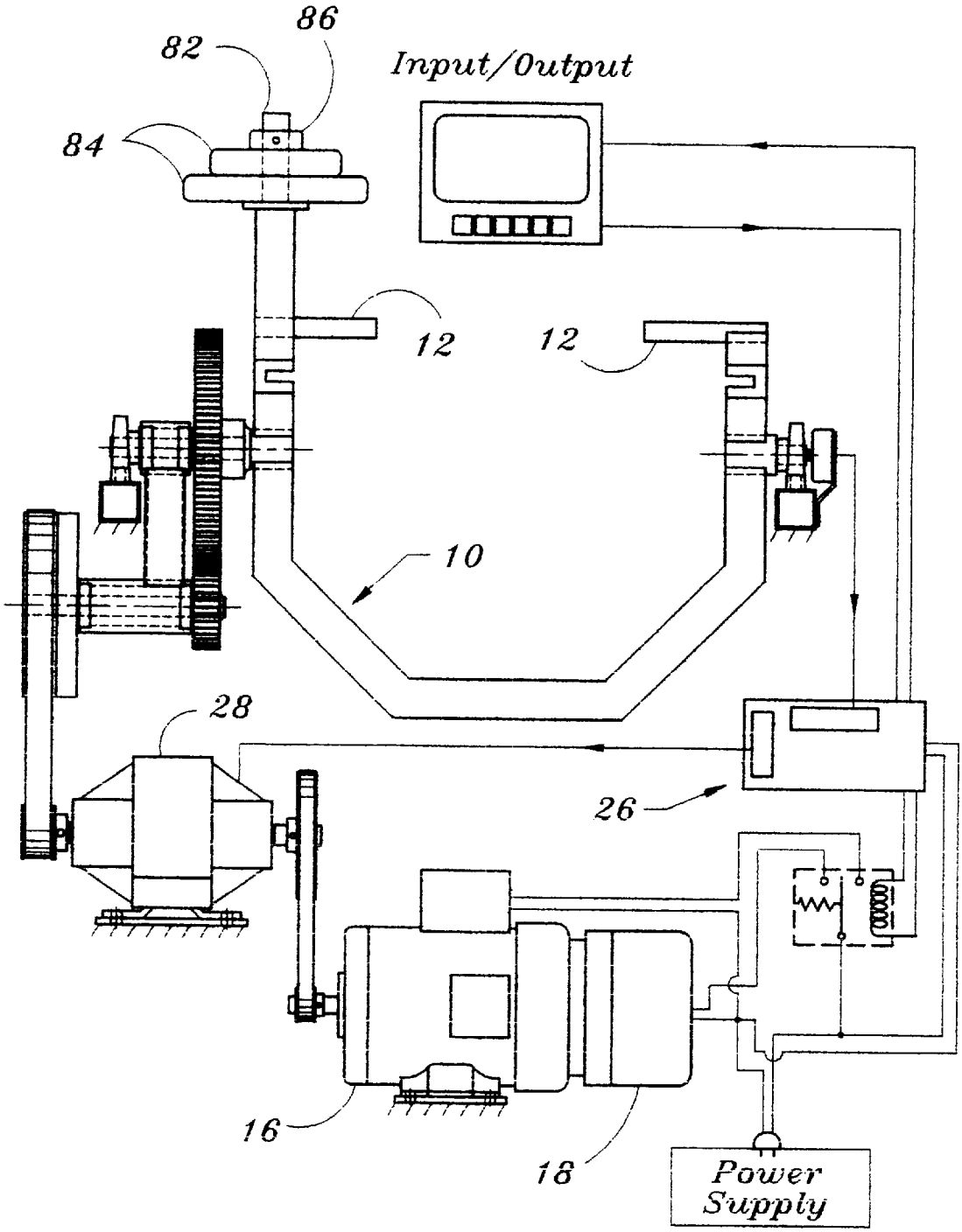
FIG. 4 is a schematic view of a force application and control system for an exercise machine with weight plates added, the device produced in accordance with an alternative preferred embodiment of the present invention.

In recognition of the desire to add a mass based resistance to the body, another example of the invention is shown in FIG. 4. The majority of the detail in the figure is similar to that of FIG. 1, including the exercise arm 10 with handles 12, the drive motor 16, the brake 18 and clutch 28. Here the exercise arm 10 also includes a plate pin 82 to support weight plates 84. A collar 86 or other locking device is likely desirable, but would not always be necessary, to releasably secure the weight plates 84 to the plate pin 82. The weight plates 84 can take a variety of forms in that they are an element of mass that in the presence of gravity causes a moment on the exercise arm 10 which must be overcome by the user. This depicts the most basic system in that the weights 84 are directly added to the arm 10.

Figure 5:
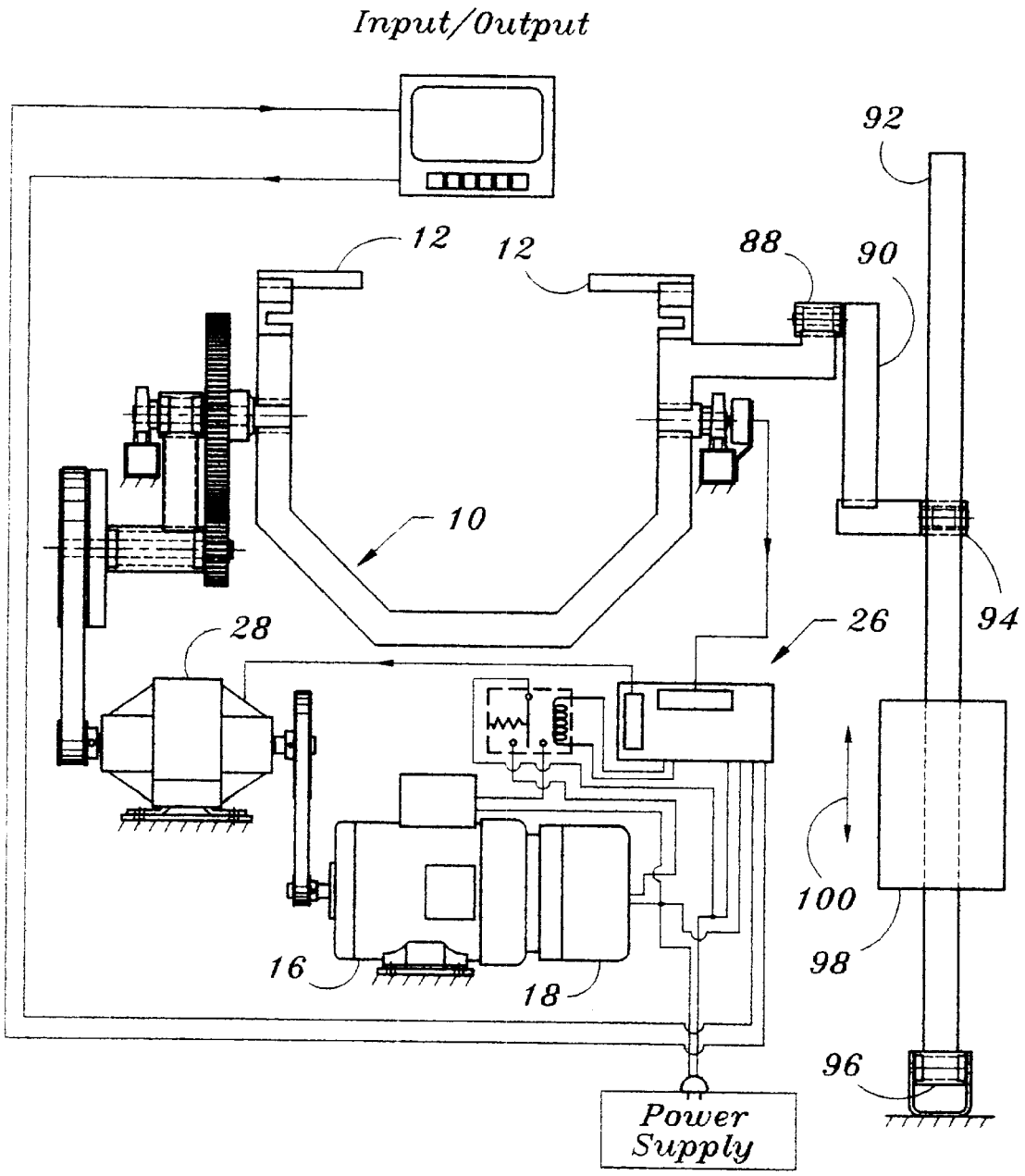
FIG. 5 is a schematic view of a force application and control system for an exercise machine with a weighted adjustable force mechanism, the device produced in accordance with an alternative preferred embodiment of the present invention.

In many cases it is desirable to add the weight indirectly to the exercise arm of an exercise machine. An example of this is shown in FIG. 5. Again, a similar system is shown as previously disclosed. In this figure, the exercise arm 10 is again modified, but this time to include an arm link pivot 88 to accommodate pivotal attachment of an arm link 90 to the exercise arm 10. A weight arm 92 includes a front pivot 94 which receives the opposite end of the arm link 90, thus creating a linkage connecting the exercise arm 10 to the weight arm 90. The base end of the weight arm 92 is shown here to be pivotally attached to the frame by a base pivot 96. The base pivot 96 thereby creates a fulcrum for the weight arm 92 that moves in accordance with movement of the exercise arm 10. A weight 98 is supported by the weight arm 92. The weight 98 is shown here to be capable of movement as shown by the arrow 100. When the weight 98 is positioned farther away from the base pivot 96 (fulcrum) the moment applied to the exercise arm 10 is greater than when the weight 98 is positioned closer to the base pivot 96. This system allows for a variation in resistance according to the desire of the user without adding or removing weights. Either system, adding weights by weight plates or a system of weights in a stack (not shown), or this mass positioned relative to pivoting fulcrum are examples of many different forms of adding a gravity based resistance element to the invention. These as disclosed are examples and the scope of the invention is not intended to be limited to these examples.

A limited range of motion for all systems which include a gravity based resistance system can be obtained by utilizing the arrangement similar to that previously described. With a gravity based resistance, the reversible motor 16 drives the exercise arm 10 with the added weight to the lowest position. This is held in place by the brake 18 with the clutch 28 actuated. The "brake" is released by actually disengaging the brake 18 or the clutch 28 when the load to the system is removed. This can be as noted by the load sensor 59 or slight movement concentrically, as detected by the sensor 50. This slight movement is possible even with the brake 18 engaged due to the flexion of the structure of the exercise arm 10 and supportive structures. The arm 10 is then free to move concentrically to the limit of that user's discretion. The eccentric movement is then stopped at the position as indicated. This cycle can be repeated as necessary.

Figure 6:
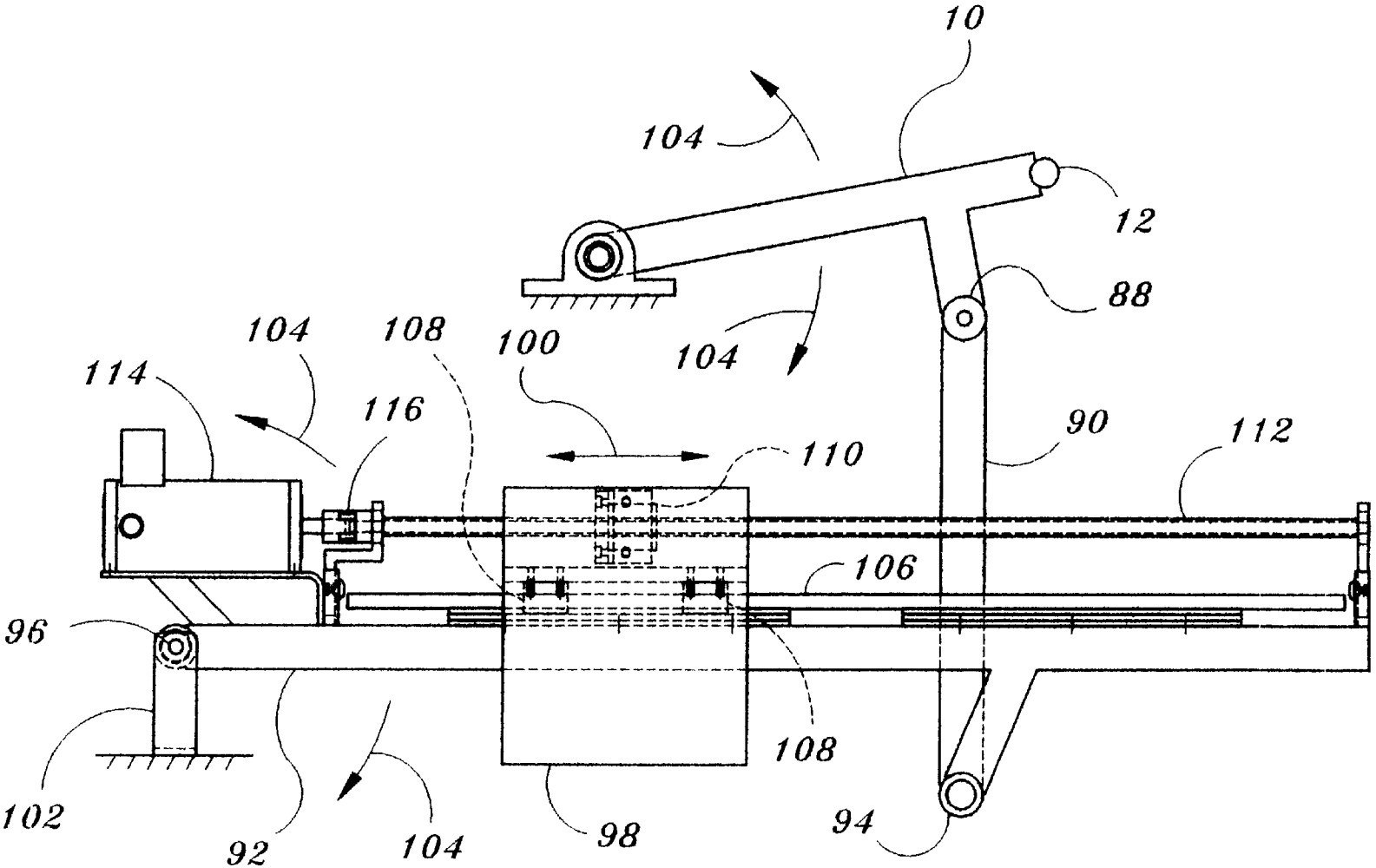
FIG. 6 is a side view of a weighted adjustable force mechanism, the mechanism produced in accordance with a preferred embodiment of the present invention.

To further clarify and show more detail of a fulcrum type weight system as previously shown, a side view of one form of such an apparatus is depicted in FIG. 6. Here the weight arm 92 is supported by a bracket 102 which is secured to the frame. The base pivot 96 being the fulcrum. The exercise arm 10, including handle 12, supports arm link pivot 88. The arm link 90 connects to the front pivot 94, which is supported by the weight arm 92. The combination is shown in a middle position, thus movement of both the exercise arm 10 and the weight arm 92 can be effected in a clockwise or counter clockwise direction as designated by the arrows 104.

The weight 98 is shown here to be supported on a shaft 106 and linear bearings 108, the shaft 106 being supported by the weight arm 92. The block 98 supports a screw nut 110 which receives a lead screw 112. The lead screw 112 is turned by the screw motor 114 through the coupling 116. The lead screw 112 moves the weight 98, by virtue of the screw nut 110, to various positions relative to the base pivot 96. This varying position alters the tension in the arm link 90 which in turn varies the torque on the exercise arm 10. This drive system enables the weight to be actuated, varying the load on the user, while the exercise arm 10 is in use. This can be an advantage in that a lower force can be placed on the user for the first "warm up" repetitions and then increased during the exercise. The load may then be decreased as the user fatigues during the exercise session, thus enabling the user to continue the exercise for one or more repetitions.

For the invention as disclosed herein, the actuated system as shown and described is highly beneficial and considered a preferred embodiment, but it is not necessary to the function of the invention. For a leverage type system such as this, the weight 98 could be manually positioned and then secured to the weight arm 92 by various means common in the art.

The linkage system shown here is only one of a variety of possible structures. It is desirable to match the moment applied by the system at any position to the force versus position potential of the muscles of that joint. In doing this, the positions and configurations of the linkage arrangement can change from that shown here. Flexible links such as cables and belts can also be used with cams to vary the load versus position relationship. In either case, what is shown here is one example of the numerous variations of the disclosed invention.

What is claimed is:

1. A machine force system and control for an exercise device comprising:

an exercise arm with an engagement portion for providing force transmission between a user and the exercise-device;

a mechanical power system comprising:

a drive motor;

a clutch with an input in mechanical communication with said drive motor and an output in mechanical communication with said exercise arm, the clutch enabling variable power transfer from said motor to said exercise arm; and an independent brake coupled to said input of said clutch, the brake, when actuated providing restriction to movement of said input of said clutch.

2. The machine force system and control as described in claim 1, wherein said drive motor is an electric motor.

3. The machine force system and control as described in claim 2, wherein said electric motor is a reversible electric motor.

4. The machine force system and control as described in claim 1, wherein said drive motor is a reversible motor.

5. The machine force system and control as described in claim 1, wherein said clutch is an electrically controlled clutch.

6. The machine force system and control as described in claim 5, wherein said electrically controlled clutch is an electric particle clutch.

7. The machine force system and control as described in claim 1, wherein said mechanical communication of said output of said clutch comprises a gear reduction.

8. The machine force system and control as described in claim 7, wherein said gear reduction includes a multiple reduction.

9. The machine force system and control as described in claim 8, wherein said multiple reduction includes a belt, pulley and a gear.

10. The machine force system and control as described in claim 1, wherein said brake is electrically actuated.

11. The machine force system and control as described in claim 1, wherein said brake is coupled to said input of said clutch directly between said motor and said clutch.

12. The machine force system and control as described in claim 1, wherein said brake is indirectly coupled to said input of said clutch by being directly connected to said motor and said motor being directly connected to said input of said clutch.

13. The machine force system and control as described in claim 12, wherein said brake directly brakes said drive motor.

14. The machine force system and control as described in claim 1, wherein said brake and said clutch are housed in a single unit.

15. The machine force system and control as described in claim 1, wherein said mechanical power system further comprises a relay, controlled by a microprocessor unit, wherein said relay transfers power between said drive motor and said brake.

16. The machine force system and control as described in claim 15, wherein said relay is an electric relay.

17. The machine force system and control as described in claim 1, wherein said position sensor comprises an optical encoder.

18. The machine force system and control as described in claim 1, further comprising an input/output device enabling data input and providing information feedback to said user.

19. The machine force system and control as described in claim 18, wherein said information feedback system comprises a form of communication selected from the group consisting of audio, visual and tactile.

20. The machine force system and control as described in claim 18, wherein said input/output device includes an audio communication system providing audio feedback, said audio communication system including an audio sound system with speakers.

21. The machine force system and control as described in claim 18, wherein said input/output device includes a visual communication system having a display monitor that provides visual feedback.

22. The machine force system and control as described in claim 21, wherein said display monitor is a monitor selected from the group consisting of a liquid crystal display and a cathode ray tube.

23. The machine force system and control as described in claim 18, wherein said input/output device includes a communication system comprising a vibrator that provides tactile feedback.

24. The machine force system and control as described in claim 18, wherein said information feedback comprises one or more performance specifications selected from the group consisting of force, exercise arm position, repetitions performed and work done per exercise session.

25. The machine force system and control as described in claim 18, wherein said data input comprises an identification input that identifies said specific user.

26. The machine force system and control as described in claim 18, wherein said input/output device further comprises a reader that is capable of identifying said specific user by reading electronically imprinted data.

27. The machine force system and control as described in claim 1, further comprising a load sensor, the load sensor enabling measurement of said force transmission between said user and said exercise device.

28. The machine force system and control as described in claim 1, further comprising a position sensor providing data relative to the displacement of said exercise arm; and a microprocessor unit in communication with said position sensor and said mechanical power system, said microprocessor processing data from said position sensor to adjust power output from said mechanical power system.

29. A machine force system and control for an exercise device comprising:

an exercise arm with an engagement portion for providing force transmission between a user and the exercise device;

a force generation system comprising:

a drive motor;

a clutch with an input in mechanical communication with said drive motor and an output in mechanical communication with said exercise arm, the clutch enabling variable power transfer from said motor to said exercise arm;

a secondary force mechanism in mechanical communication with said exercise arm and applying a load to oppose a movement of said exercise arm; and an independent brake coupled to said input of said clutch the brake, when actuated, providing restriction to movement of said input of said clutch.

30. The machine force system and control as described in claim 29, wherein said drive motor is an electric motor.

31. The machine force system and control as described in claim 30, wherein said electric motor is a reversible electric motor.

32. The machine force system and control as described in claim 29, wherein said drive motor is a reversible motor.

33. The machine force system and control as described in claim 29, wherein said clutch is an electrically controlled clutch.

34. The machine force system and control as described in claim 33, wherein said electrically controlled clutch is an electric particle clutch.

35. The machine force system and control as described in claim 29, wherein said a secondary force mechanism further comprises a weight of a given mass.

36. The machine force system and control as described in claim 35, wherein said weight comprises a plurality of individual weights plates.

37. The machine force system and control as described in claim 36, wherein said individual weight plates are releasably mounted directly on said exercise arm.

38. The machine force system and control as described in claim 36, wherein said individual weight plates are moveably mounted on a lever, the lever in mechanical communication with said exercise arm.

39. The machine force system and control as described in claim 35, wherein said weight consists essentially of a single weight block.

40. The machine force system and control as described in claim 39, wherein said single weight block is releasably mounted directly on said exercise arm.

41. The machine force system and control as described in claim 39, wherein said single weight block is moveably mounted on a lever, the lever in mechanical communication with said exercise arm.

42. The machine force system and control as described in claim 29, wherein said mechanical communication of said output of said clutch comprises a gear reduction.

43. The machine force system and control as described in claim 42, wherein said gear reduction comprises a multiple reduction.

44. The machine force system and control as described in claim 29, wherein said brake is electrically actuated.

45. The machine force system and control as described in claim 29, wherein said brake is connected to said input of said clutch directly between said motor and said clutch.

46. The machine force system and control as described in claim 29, wherein said brake is indirectly connected to said input of said clutch by being directly connected to said motor and said motor being directly connected to said input of said clutch.

47. The machine force system and control as described in claim 46, wherein said brake directly brakes said drive motor.

48. The machine force system and control as described in claim 29, wherein said brake and said clutch are housed in a single unit.

49. The machine force system and control as described in claim 29, wherein said mechanical power system further comprises a relay, controlled by a microprocessor unit, wherein said relay transfers power between said drive motor and said brake.

50. The machine force system and control as described in claim 49, wherein said relay is an electric relay.

51. The machine force system and control as described in claim 29, wherein said position sensor comprises an optical encoder.

52. The machine force system and control as described in claim 29, further comprising an input/output device enabling data input and providing information feedback to said user.

53. The machine force system and control as described in claim 52, wherein said information feedback comprises a form of communication selected from the group consisting of audio, visual and tactile.

54. The machine force system and control as described in claim 52, wherein said input/output device includes an audio communication system providing audio feedback, said audio communication system including an audio sound system with speakers.

55. The machine force system and control as described in claim 52, wherein said input/output device includes a visual communication system having a display monitor that provides visual feedback.

56. The machine force system and control as described in claim 55, wherein said display monitor is a monitor selected from the group consisting of a liquid crystal display and a cathode ray tube.

57. The machine force system and control as described in claim 52, wherein said input/output device includes a communication system comprising a vibrator that provides tactile feedback.

58. The machine force system and control as described in claim 52, wherein said information feedback comprises one or more performance specifications selected from the group consisting of force, exercise arm position, repetitions performed and work done per exercise session.

59. The machine force system and control as described in claim 52, wherein said data input comprises an identification input that identifies said specific user.

60. The machine force system and control as described in claim 52, wherein said input/output device further comprises a reader that is capable of identifying said specific user by reading electronically imprinted data.

61. The machine force system and control as described in claim 29, further comprising a load sensor, the load sensor enabling measurement of said force transmission between said user and said exercise device.

62. The machine force system and control as described in claim 29, further comprising a position sensor providing data relative to the displacement of said exercise arm; and a microprocessor unit in communication with said position sensor, and said mechanical power system, said microprocessor processing data from said position sensor to adjust power output from said mechanical power system.

* * * * *